United States Patent [19]

Pozzobon et al.

[11] Patent Number: 4,796,829

[45] Date of Patent: Jan. 10, 1989

[54] WINDER SAFETY DEVICE, PARTICULARLY FOR SKI BOOTS

[75] Inventors: Alessandro Pozzobon, Paderno Di Ponzano Veneto; Pietro Manfré, Vedelago, both of Italy

[73] Assignee: Nordica S.p.A., Montebelluna, Italy

[21] Appl. No.: 105,623

[22] Filed: Oct. 7, 1987

[30] Foreign Application Priority Data

Oct. 20, 1986 [IT] Italy ..... 82584 A/86

[51] Int. Cl.[4] ..... B65H 75/38; A43B 11/00; A43B 5/04

[52] U.S. Cl. ..... 242/100; 36/119; 36/50

[58] Field of Search ..... 242/100; 36/50, 119; 254/213, 219, 222, 223

[56] References Cited

U.S. PATENT DOCUMENTS 3,927,580 12/1975 Fawcett ..... 254/346 X 4,433,456 2/1984 Baggio ..... 36/50 X

*Primary Examiner*—John Petrakes

*Assistant Examiner*—Steven M. duBois

*Attorney, Agent, or Firm*—Guido Modiano; Albert Josif

[57] ABSTRACT

Winder safety device comprising a manually operable knob which is provided with a stem rotatably associated with a supporting element, provided on a portion of a ski boot, to said supporting element being pivoted coaxial with the stem a winder of at least one elastic traction element lockable against rotation by external locking mean. A drive wheel is keyed to the knob for rotation therewith and free to slide axially with respect to the stem, the drive wheel is provided with a first gear which meshes unidirectionally with a facing second gear rigidly associated with the winder. The configuration of the first gear and of the second gear is such that the two gears engage without meshing with each other upon a rotation opposite to the winding of said at least one traction element.

5 Claims, 2 Drawing Sheets

WINDER SAFETY DEVICE, PARTICULARLY FOR SKI BOOTS

BACKGROUND OF THE INVENTION

The present invention relates to a winder safety device, particularly for use with winders of traction elements associated with a ski boot.

Known winders for traction elements, such as cables, bands or the like, acting on pressers or fastening in a ski boot, are currently operable by means of a knob which can be accessed from outside; the winders usually interact with a releasable locking element in order to allow the skier to lock or unwind the traction element.

Said releasable locking elements usually consist of ratchet mechanisms, with springs acting on a shaft or of arrester notches provided on the knob.

Such known devices are not free from disadvantages: in fact, at the moment in which the locking element is held in the unlocking position and the knob is intentionally rotated in the direction of unwinding of the traction element, the complete unwinding point may be exceeded, consequently causing the winding of said traction element in the opposite direction. This winding of the traction element in the wrong direction may eventually jam or even damage the winding mechanism.

SUMMARY OF THE INVENTION

The aim of the present invention is therefore to eliminate the disadvantages described above in of winders of known type, by providing a device which allows to transmit motion to the winding element only in the direction of winding of said traction element.

Within the scope of the above described aim, another important object of the present invention is to provide a device which is structurally simple, has a limited number of components, occupies little room and can thus be easily coupled to winders of traction elements associated with a ski boot.

Not least object is to provide a device which is further remarkably simple in use.

The aim and the objects described above, as well as others which will become apparent hereinafter, are achieved by a winder safety device, comprising a supporting element defined by a ski boot an operating knob axial means for linking said stem to said supporting means so as permit both a loose rotatory movement and a limited axial movement between said stem and said supporting means a drive wheel faceted means for connecting in rigid rotatory relationship said drive wheel to said stem while allowing for an axial movement between said drive wheel and said stem a first gear provided on said drive wheel a winder a flexible traction element having a portion thereof secured to said winder so as to be able to be wound on said winder said winder being pivotally mounted on said supporting element and being arranged for coaxial rotation with respect to said stem, in a direction of winding and in a direction of unwinding of said flexible traction element, a second gear defined by said winder, said second gear being arranged in facing relationship with said first gear for substantially continuous engagement therewith, said first gear and said second gear being so shaped that, upon driving of said first gear in said winding direction, said first gear is caused to mesh unidirectionally with said second gear to permit transmission of drive between said knob and said winder in said winding direction and, upon driving of said first gear in said unwinding direction, said first gear is automatically caused to engage without meshing with said second gear to prevent transmission of drive from said knob to said winder in said unwinding direction, whereby insuring safe unidirectional winding of said traction element.

BRIEF DESCRIPTION OF THE DRAWINGS

Further characteristics and advantages of the invention will become apparent from the detailed description of a particular embodiment, illustrated only by way of non-limitative example in the accompanying drawings, wherein.

DESCRIPTION OF THE PREFERRED EMBODIMENTS

Figures 1, 2, 3, 4:
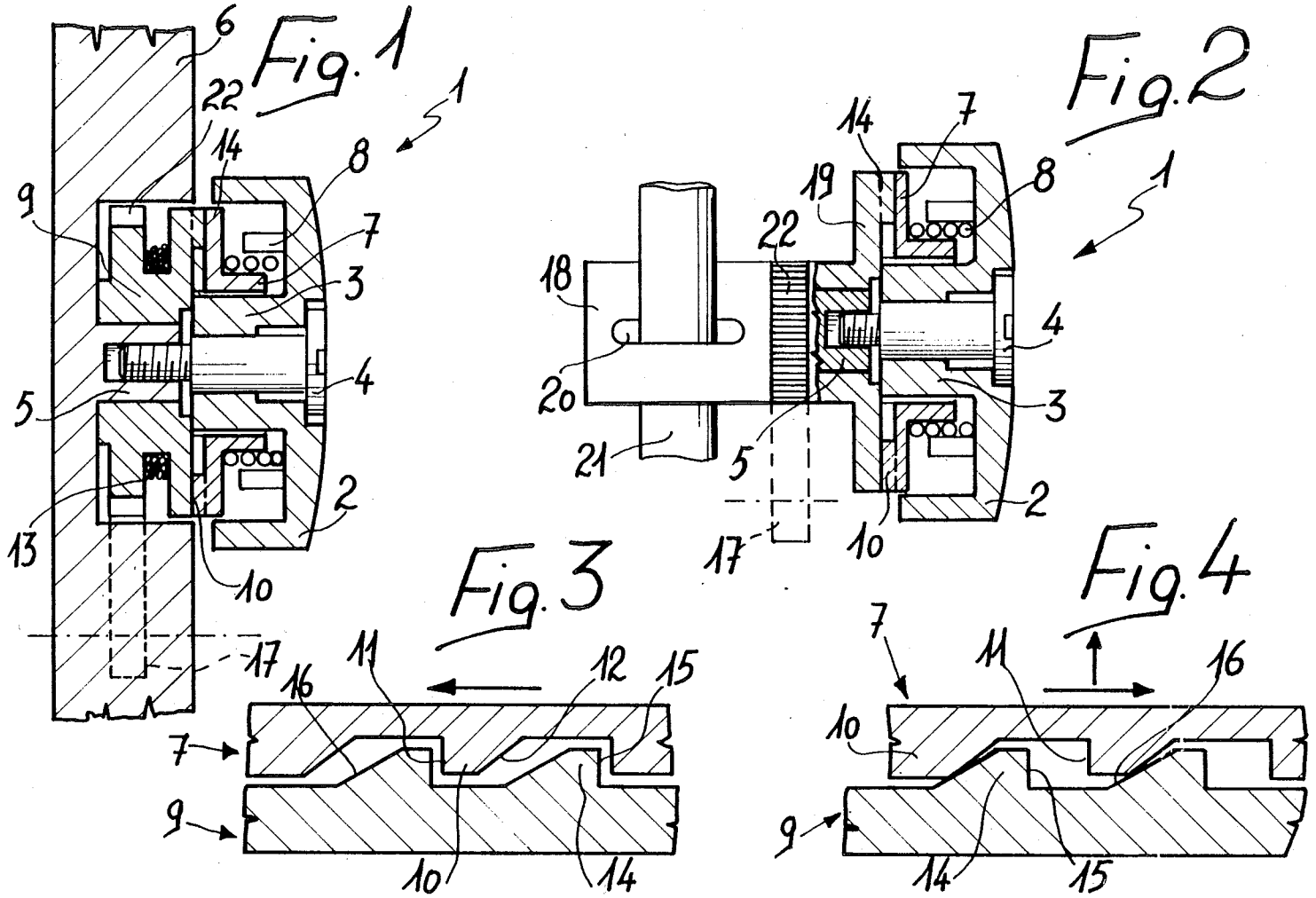
FIG. 1 is a lateral section view of the device according to the invention.
FIG. 2 is a view, similar to the preceding one, of the device applied to a different winder.
FIG. 3 is a schematic section view of the first gear of the drive wheel and of the second gear of the winder in the condition in which they mesh with one another.
FIG. 4 is a view, similar to the preceding one, of the condition of engagement without meshing of the first gear and of the second gear.

With reference to the previously described figures, the safety device 1 comprises an operating knob 2 provided with a stem portion 3 rotatably associated, by link means of known type such as for example a screw 4, with a supporting element 5 which protrudes from a portion 6 of a ski boot (here not illustrated in the figure for simplification purposes).

The stem 3 is provided with a lateral faceting 31 for the complementary coupling with a drive wheel 7. Between the facing surfaces of the drive wheel 7 and of the operating knob 2 there is interposed an elastically deformable means consisting of a spring 8.

Said coupling between the drive wheel 7 and the stem 3 allows the wheel 7 to move axially with respect to the stem 3, whilst preventing any relative rotary motion between these two parts.

The wheel 7 is provided, at the surface facing a winder 9 pivoted to the supporting element 5 coaxially to the stem 3, with a first gear having a plurality of first teeth 10 equally spaced with respect to one another and having a polygonal cross section preferably in the shape of an isosceles trapezium.

Each tooth is thus provided with a front face 11 extending in a plane passing through the axis of to the wheel 7 and with a face 12 which extends in a plane inclined with respect to the front face 11.

Said first gear meshes unidirectionally, that is to say in the only direction of winding of a tractio element 13 associated with the winder 9, with a facing second gear rigidly associated with said winder 9.

Said second gear is thus composed of a plurality of second teeth 14 similar in shape to the teeth 10 and thus having a front face 15 extending in a plane passing through the axis of the winder 9, so arranged to abut against a corresponding front face 11 of the first gear and a front face 16, which extends in a plane inclined with respect to the face 15 and arranged to slide on a corresponding back face 12 of the front gear.

The winder 9 furthermore cooperates with a locking and/or unlocking element, associated with a portion 6 of the ski boot, and consisting, for example, of a ratchet 17 acting on a set of teeth 22 rigidly associated with the winder 9 and only schematically illustrated in the figures.

The winder 9 can be composed of a winding pulley for a cable, as illustrated in FIG. 1 or, in an equivalent manner, of a winder shaft 18, with an end whereof there being associated a wheel 19 interacting with the wheel 7 and thus having a plurality of teeth 14 defining the second gear in a manner fully similar to what has been described above. A longitudinal groove 20 is provided on said winder shaft 18, acting as seat for a winding band 21, as well as a toothed region 22 interacting with the ratchet 17 as described above.

The use of the safety device is therefore as follows: by rotating the operating knob 2 in the direction of winding of the cable 13 or of the band 21, the teeth 10 of the drive wheel 7 will mesh with the teeth 14 constituting the second gear, thus causing the rotation of the pulley or winding shaft.

This condition, illustrated in FIG. 3, thus allows to wind the cable or the band.

To unwind the traction element, the skier simply has to act on the locking-unlocking element 17: in this manner the tension of the traction element causes the unwinding thereof with the consequent rotation in the opposite direction of the teeth 14.

Thus, in this condition the motion is transmitted to the drive wheel 7 and then to the knob 2.

If the user, in the unlocking position of the device, were to intentionally rotate the knob in the direction of unwinding, said knob would not transmit the motion to the winder since the teeth 14 would interact, at the second face 16, with the complementary face 12 of the teeth 10 causing the translatory motion of the drive wheel 7 along the axis of the stem 3 of the knob 2.

The elastic reaction to the axial translatory motion is ensured by the presence of the spring 8.

Since a rotary motion of the wheel 7 is not transmitted to the winder 9 if the knob 2 is rotated in the direction of unwinding of the traction element avoids, thus the accidental rewinding thereof in the wrong direction is inhibited.

It has thus been observed that the invention achieves the intended aim and objects, a safety device having been provided which allows to transmit the motion to the winding element only in the direction of winding of the traction element.

The device is furthermore structurally very simple, being composed of a limited number of components.

This allows the device to have limited dimensions, giving it the characteristic of being easily applied to known winders for traction elements operating in a ski boot.

Figure 5:
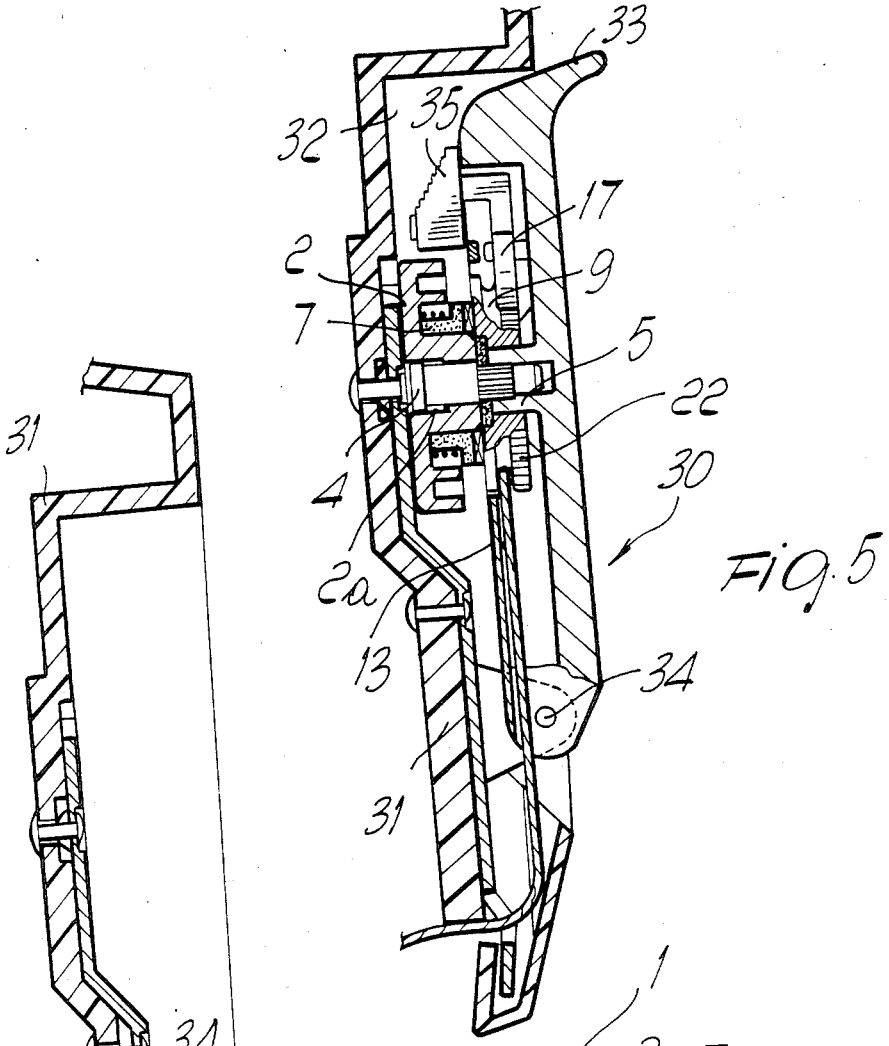
FIG. 5 is a lateral elevation view, in cross section, of the device applied to a lever associated with a boot.
Figure 6:
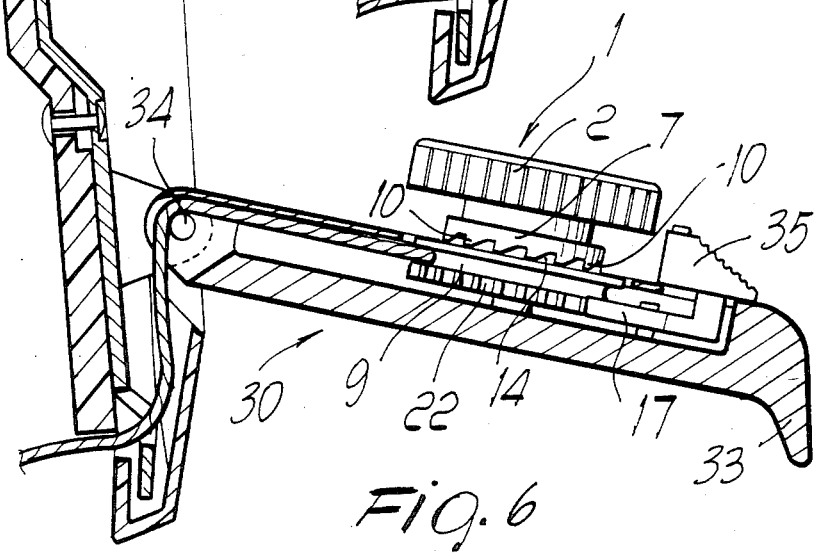
FIG. 6 is a view, similar to that of FIG. 5 in partial cross section, of the lever and device assembly in the open position.

For example, the safety device 1, according to the invention, can be applied to a lever 30, of the type described in the U.S. patent application Ser. No. 06/897564, as illustrated in FIGS. 5–6. The lever 30 is pivoted to a ski boot, not illustrated herein for the sake of simplicity, for example in the region 31 of the rear quarter, and supports the safety device 1 adapted for the winding of a cable 13 acting for example in a known manner on a foot presser, not illustrated herein.

The lever 30 has a closed position, illustrated in FIG. 5, in which the device 1 is accommodated in the seat 32 and is protected by the body of the lever 30 arranged, in this position, on the outer side of the region 31 of the boot.

By acting on the tab 33 it is possible to rotate the lever 30 about its pivoting axis 34, until it reaches an open position for the actuation of the device 1, as illustrated in FIG. 6.

In order to facilitate the grip by the user, the knob 2 can advantageously be moved outwards when the lever 30 is opened. For this purpose the knob 2 is provided with a recessed portion **2*a* at the accommodation hole of the screw 4 for coupling to the supporting element 5 of the lever 30**.

With the lever 30 in closed position, the knob 2 is in abutment with the drive wheel 7 comprising the interposed spring 8. By opening the lever 30 the spring 8 pushes outwards the knob 2 by a portion determined by the axial dimensions of the recessed portion **2*a***.

In this manner the operator can easily act on the knob 2 which is always in the extracted position (FIG. 6) every time the lever 30 is opened.

In order to disengage the winder 9, the operator acts on the pushbutton 35 which controls the ratchet 17 which interacts with the gear 22 in a per se known manner.

Naturally the invention is susceptible to numerous modifications and variations, all of which are within the scope of the same inventive concept.

The materials, as well as the dimensions of the individual components of the device, may naturally be any according to the specific requirements.

We claim:

1. A winder safety device, particularly for ski boots, comprising:

a supporting element defined by a ski boot an operating knob a stem defined by said knob axial means for linking said stem to said supporting means so as to permit both a loose rotatory movement and a limited axial movement between said stem and said supporting means a drive wheel faceted means for connecting in rigid rotatory relationship said drive wheel to said stem while allowing for an axial movement between said drive wheel and said stem a first gear provided on said drive wheel a winder a flexible traction element having a portion thereof secured to said winder so as to be able to be wound on said winder said winder being pivotally mounted on said supporting element and being arranged for coaxial rotation with respect to said stem, in a direction of winding and in a direction of unwinding of said flexible traction element, a second gear defined by said winder, said second gear being arranged in facing relationship with said first gear for substantially continuous engagement therewith, said first gear and said second gear being so shaped that, upon driving of said first gear in said winding direction, said first gear is caused to mesh unidirectionally with said second gear to permit transmission of drive between said knob and said winder in said winding direction and, upon driving of said first gear in said unwinding direction, said first gear is automatically caused to engage without meshing with said second gear to prevent transmission of drive from said knob to said winder in said unwinding direction, whereby insuring safe unidirectional winding of said traction element.

2. A device, according to claim 1, wherein said first gear includes a plurality of first teeth which are mutually equally spaced and identically shaped to each other with a polygonal cross section, each of said first teeth having a first front face and a first back face, said first front face extending substantially in an axial plane of said first gear, said first back face extending obliquely of said first front face.

3. A device, according to claim 1, wherein said second gear includes a plurality of second teeth shaped so as to complementary match with said first teeth, each of said second teeth having a second front face and a second back face, said second front face extending in an axial plane of said second gear, said second back face extending obliquely of said second front face, said first and said second front faces being adapted to come into abutting engagement, said first and said second back faces being adapted to come into slidable engagement.

4. A device, according to claim 1, wherein an elastically deformable means is interposed between respective opposed abutting surfaces of said operating knob and said drive wheel, said elastically deformable means acting on said drive wheel on a side opposite to said first gear to urge said first gear towards said second gear whereby providing a substantially releasable engagement therebetween.

5. A device, according to claim 1, wherein there are provided means for releasably locking said winder against rotation about the rotation axis thereof in any selected rotational position of said winder.

* * * * *